United States Patent [19]

Schoemann et al.

[11] 4,224,751

[45] Sep. 30, 1980

[54] SNOW LIFTING DEVICE

[76] Inventors: George J. Schoemann, 2906 W. Bottsford Ave., Greenfield, Wis. 53221; Robert Schoemann, 2032 S. 94th St., West Allis, Wis. 53227

[21] Appl. No.: 5,039

[22] Filed: Jan. 22, 1979

[51] Int. Cl.[3] ..... E01H 5/02

[52] U.S. Cl. ..... 37/53; 294/55; 294/59

[58] Field of Search ..... 37/53, 130; 299/54, 299/55, 59

[56] References Cited

U.S. PATENT DOCUMENTS

| | | | |
|---|---|---|---|
| 860,746 | 7/1907 | Hoffman | 294/55 |
| 2,666,662 | 1/1954 | McLeod | 294/54 X |
| 3,007,263 | 11/1961 | Lair | 37/53 |
| 3,106,303 | 10/1963 | Finocchiaro | 37/130 X |
| 3,475,838 | 11/1969 | Hagen et al. | 37/53 |
| 4,019,768 | 4/1977 | Niece | 294/55 |
| 4,024,654 | 5/1977 | Snyder | 37/53 |
| 4,089,127 | 5/1978 | Maijala | 37/53 |

*Primary Examiner*—E. H. Eickholt

*Attorney, Agent, or Firm*—Richard P. Ulrich

[57] ABSTRACT

A device for snow removal comprising: a frame, a flexible scoop, and means for flexing and relaxing the scoop.

3 Claims, 2 Drawing Figures

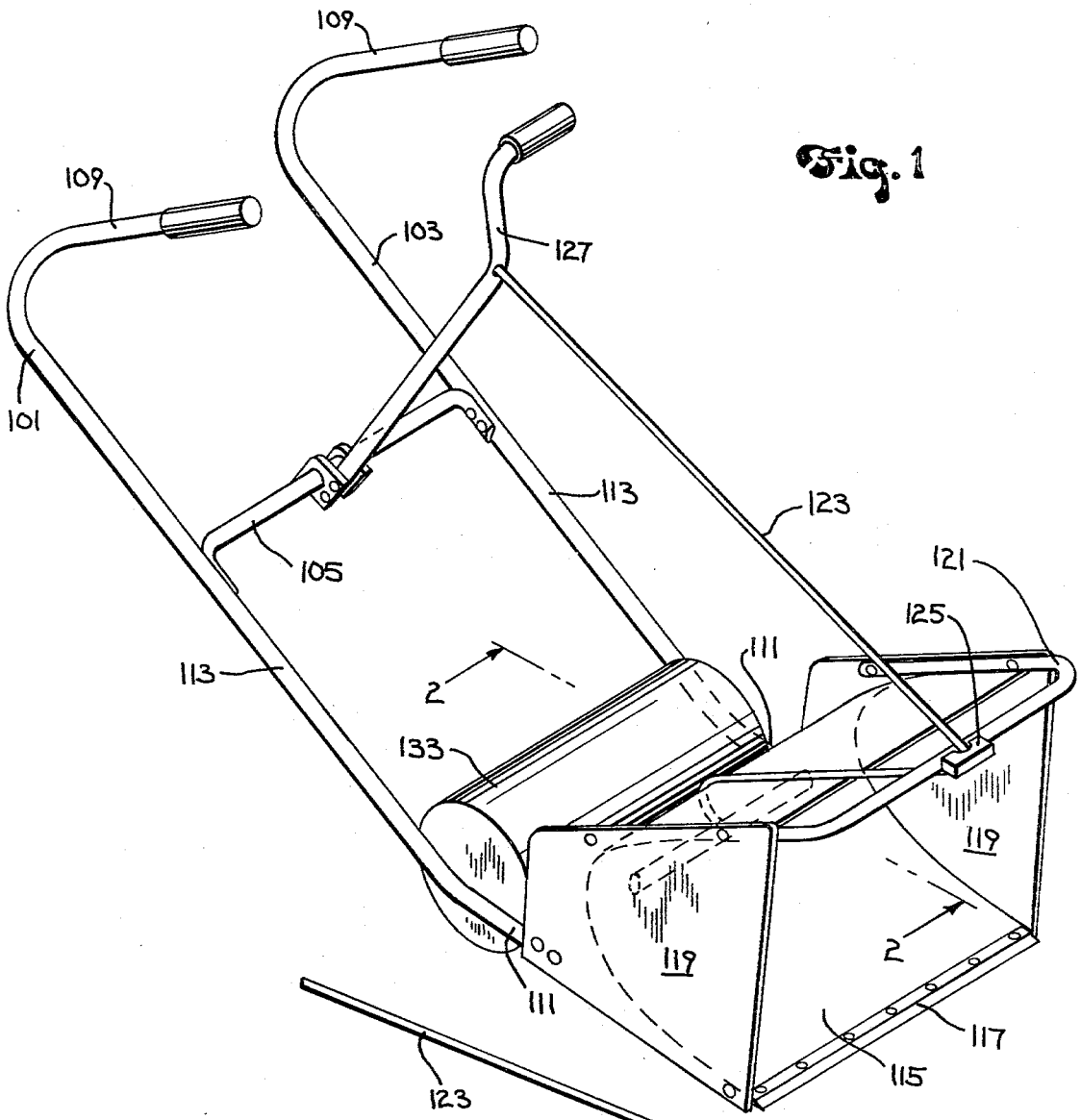
Fig. 1
Fig. 2
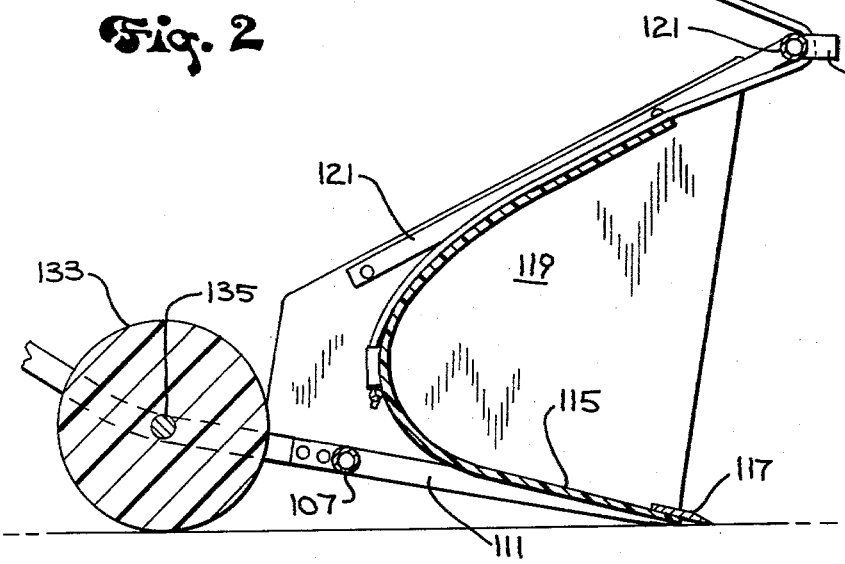

SNOW LIFTING DEVICE

BACKGROUND AND SUMMARY OF THE INVENTION

In the northern part of the United States, removing snow from sidewalks and driveways is a nasty winter job. This job has been made easier in the last few years by the common of powered snow throwers to replace the shovel. However, many people do not want or require a snow thrower but do want or need something more efficient and easier to use than a shovel.

Therefore, it is an object of this invention to aid and assist in performing the task of removing snow in a more efficient way.

It is a further object of this invention to remove snow without the back breaking labor of shoveling.

It is an additional object of this invention, to provide the means for snow removal at a cost lower than that of powered snow throwers and without the noise that is usually generated by gasoline powered throwers.

These objectives are satisfied by our invention. Our invention comprises: a frame including a handle or handles on one end, a flexible scoop to which snow does not adhere well, which is attached to the other end of the frame in a position so that it can be pushed through and thereby loaded with snow and means for ejecting the snow from the scoop when desired.

In this specification the flexible scoop is called a blanket. In addition, when the flexible scoop or blanket is in a position to receive snow it will be referred to as relaxed, and when the blanket is ejecting snow it will be referred to as flexed.

In the preferred embodiment of this invention, a pair of upturned hand-holds are used thereby enabling the user to step between the side rails of the frame and get in a good position to use the device. In addition, the upturned hand-holds provide automatic adjustment for the height of the user, and allow the handles to be pushed all the way to the ground level thereby elevating the scoop end of the device the maximum amount above the ground.

DESCRIPTION OF THE DRAWINGS

FIG. 1 is a perspective view of the device

FIG. 2 is a sectional view taken along line 2—2 of FIG. 1.

DESCRIPTION OF THE PREFERRED EMBODIMENT

Referring to FIG. 1, the frame of the device comprises, right rail 101, and left rail 103 which are held together and maintained in proper spaced relationship by handlever brace 105 and axle brace 107. In the preferred embodiment of this invention, the rails are made of one inch steel tubing which has been bent at its rear end to form hand holds 109 and bent intermediate the ends to form a base portion 111 and a handle portion 113. The angle of the intermediate bend, although not critical, was made approximately 30° with respect to ground level in the model. The principal criterion for determining the amount of bend is that the hand-holds be in a comfortable position for pushing the device.

Blanket 115, which is made of polypropylene sheet stock in the preferred embodiment, is attached between the rails at the front end of the frame. In the preferred embodiment, blade 117, which is attached between rails 101 and 103 and also to the leading edge of blanket 115, provides the means for improving the ability of the blanket to slice through snow and also provides structural stability for the leading edge of the frame and blanket. However the invention is operative without it.

Triangular towers 119 are attached to the rails at the front ends of the frame and maintained in spaced relationship with tower brace 121. Towers 119 also help contain the snow within the cavity formed by the blanket.

Rope 123, or any other flexible means such as chain or cable, is attached on one end to the back side of blanket 115 and the other end of the rope is attached in any convenient way to the rear end of the frame after passing around tower brace 121 or through guide 125. In the preferred embodiment, rope 123 is attached to handlever 127. Handlever 127 is rotatably aatched to handlever brace 105.

Roller 133 may be rotatably attached to the frame by means of axle 135 at approximately the vertex of the intermediate angles in the side rails and will provide easy mobility and improved blade angle.

Operation

To operate the device the operator positions the blanket in its relaxed position. That is in its most nearly horizontal position. He then pushes the device into the snow filling the blanket. Then he moves the snow ladened device to the place where he wants to discharge the snow and pulls the rope. Pulling the rope causes the blanket to flex thereby forcing the snow off the blanket. This process is repeated until the unwanted snow is removed.

What is claimed is:

1. A snow removal device comprising:

(a) a frame which further comprises a pair of rails and a plurality of cross braces to maintain the rails in spaced relationship, each rail being bent at a position intermediate its ends, the angle of the bend being such as to place the rear end of the frame at a height above ground convenient for pushing;

(b) a flexible blanket attached at its leading edge between the rails at the end opposite the handle end of the frame;

(c) a blade attached between the rails of the frame and to the leading edge of the blanket;

(d) a pair of towers, each of which is attached to one rail at the front end of the frame;

(e) a tower brace which is attached between the towers and maintains them in spaced relationship; and (f) flexible cable means which is attached to the back side of the blanket on one end, passes around the tower brace and is attached to the rear end of the frame on the other end.

2. The snow removal device as claimed in claim 1 which further comprises a handlever, one end of said handlever being rotatably attached to the rear end of the frame, and the other end of the handlever being attached to the flexible cable means whereby pulling the handlever will flex the blanket.

3. The snow removal device as claimed in claim 1 wherein the rear ends of the rails are bent to form upturned hand-holds.

* * * * *